US010513747B2

(12) United States Patent
Kimura et al.

(10) Patent No.: US 10,513,747 B2
(45) Date of Patent: Dec. 24, 2019

(54) FERRITIC STAINLESS STEEL SHEET EXHIBITING SMALL INCREASE IN STRENGTH AFTER AGING HEAT TREATMENT, AND METHOD OF PRODUCING THE SAME

(71) Applicant: NIPPON STEEL & SUMIKIN STAINLESS STEEL CORPORATION, Tokyo (JP)

(72) Inventors: Ken Kimura, Kimitsu (JP); Junichi Hamada, Hikari (JP); Eiichiro Ishimaru, Hikari (JP); Akihito Yamagishi, Kashima (JP); Naoto Hansaki, Kashima (JP)

(73) Assignee: NIPPON STEEL & SUMIKIN STAINLESS STEEL CORPORATION, Tokyo (JP)

( * ) Notice: Subject to any disclaimer, the term of this patent is extended or adjusted under 35 U.S.C. 154(b) by 917 days.

(21) Appl. No.: 14/773,988

(22) PCT Filed: Mar. 14, 2014

(86) PCT No.: PCT/JP2014/056879
§ 371 (c)(1),
(2) Date: Sep. 9, 2015

(87) PCT Pub. No.: WO2014/142302
PCT Pub. Date: Sep. 18, 2014

(65) Prior Publication Data

US 2016/0017451 A1 Jan. 21, 2016

(30) Foreign Application Priority Data

Mar. 14, 2013 (JP) ..... 2013-052423

(51) Int. Cl.

| | |
|---|---|
| ***C22C 38/02*** | (2006.01) |
| ***C21D 8/00*** | (2006.01) |
| ***C21D 8/02*** | (2006.01) |
| ***C22C 38/00*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/46*** | (2006.01) |
| ***C22C 38/48*** | (2006.01) |
| ***C22C 38/50*** | (2006.01) |
| ***C22C 38/58*** | (2006.01) |
| ***C22C 38/34*** | (2006.01) |
| ***C22C 38/42*** | (2006.01) |
| ***C22C 38/44*** | (2006.01) |
| ***C22C 38/54*** | (2006.01) |
| ***C22C 38/60*** | (2006.01) |

(52) U.S. Cl.
CPC ..... *C21D 8/005* (2013.01); *C21D 8/0226* (2013.01); *C21D 8/0263* (2013.01); *C22C 38/001* (2013.01); *C22C 38/002* (2013.01); *C22C 38/004* (2013.01); *C22C 38/005* (2013.01); *C22C 38/008* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/34* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C22C 38/60* (2013.01)

(58) Field of Classification Search
CPC ..... C21D 8/005
See application file for complete search history.

(56) References Cited

U.S. PATENT DOCUMENTS

| | | | | |
|---|---|---|---|---|
| 3,134,670 | A * | 5/1964 | Prosen | A61K 6/04 420/34 |
| 5,098,652 | A * | 3/1992 | Yasui | C22C 38/40 420/45 |
| 5,413,754 | A * | 5/1995 | Yazawa | C22C 38/18 420/41 |
| 2010/0150770 | A1 | 6/2010 | Hiraide et al. | |
| 2013/0337289 | A1 | 12/2013 | Hatano et al. | |

FOREIGN PATENT DOCUMENTS

| | | |
|---|---|---|
| EP | 1 514 949 A1 | 3/2005 |
| EP | 1 571 227 A1 | 9/2005 |
| EP | 2 280 090 A1 | 2/2011 |
| EP | 2 546 377 A1 | 1/2013 |

(Continued)

OTHER PUBLICATIONS

English machine translation of JP 2000-169943 A of Abe, Masayuki et al. (Year: 2000).*

(Continued)

*Primary Examiner* — Jophy S. Koshy
(74) *Attorney, Agent, or Firm* — Birch, Stewart, Kolasch & Birch, LLP

(57) ABSTRACT

A ferritic stainless steel sheet containing, by mass %, C: 0.020% or less, Cr: 10.0% to 25.0%, N: 0.020% or less, Sn: 0.010% to 0.50%, and one or more of Ti: 0.60% or less, Nb: 0.60% or less, V: 0.60% or less, and Zr: 0.60% or less so as to satisfy Equation (1): $(Ti/48+V/51+Zr/91+Nb/93)/(C/12+N/14)\geq 1.0$, wherein a difference between a stress $\sigma 1$ ($N/mm^2$) after prestrain imparting tensile deformation with 7.5% of strain, and an upper yield stress $\sigma 2$ ($N/mm^2$) when the steel sheet is subjected to heat treatment at 200° C. for 30 minutes and then to tension again after the tensile deformation is 8 or less.

7 Claims, 1 Drawing Sheet

FOREIGN PATENT DOCUMENTS

| | | | |
|---|---|---|---|
| JP | 10-53817 | A | 2/1998 |
| JP | 2000-169943 | A | 6/2000 |
| JP | 2001-288543 | A | 10/2001 |
| JP | 2008-190003 | A | 8/2008 |
| JP | 2008-261007 | A | 10/2008 |
| JP | 2009-174036 | A | 8/2009 |
| JP | 2010-31315 | A | 2/2010 |
| JP | 2010-159487 | A | 7/2010 |
| JP | 2011-195874 | A | 10/2011 |
| JP | 2012-172161 | A | 9/2012 |
| JP | 2012-188748 | A | 10/2012 |
| JP | 2012-193392 | A | 10/2012 |
| KR | 10-2004-0075981 | A | 8/2004 |

OTHER PUBLICATIONS

"Characteristics of High Purity Fe—Cr Alloy", Edited by High Purity Fe—Cr Alloy Research Department of Special Base Research Association of The Iron and Steel Institute of Japan, (1995), pp. 54-59.

International Search Report, dated May 27, 2014, issued in PCT/JP2014/056879.

Okamoto et al., "Mechanism of Paint Bake-hardening", vol. 41, No. 2, Apr. 1989, pp. 195-206.

Written Opinion of the International Searching Authority, dated May 27, 2014, issued in PCT/JP2014/056879.

Korean Notice of Allowance and English translation thereof, dated Nov. 9, 2016, for counterpart Korean Application No. 10-2015-7023767.

Extended European Search Report, dated Oct. 18, 2016, for European Application No. 14765146.7.

European Office Action dated Oct. 23, 2017, for corresponding European Application No. 14765146.7.

* cited by examiner

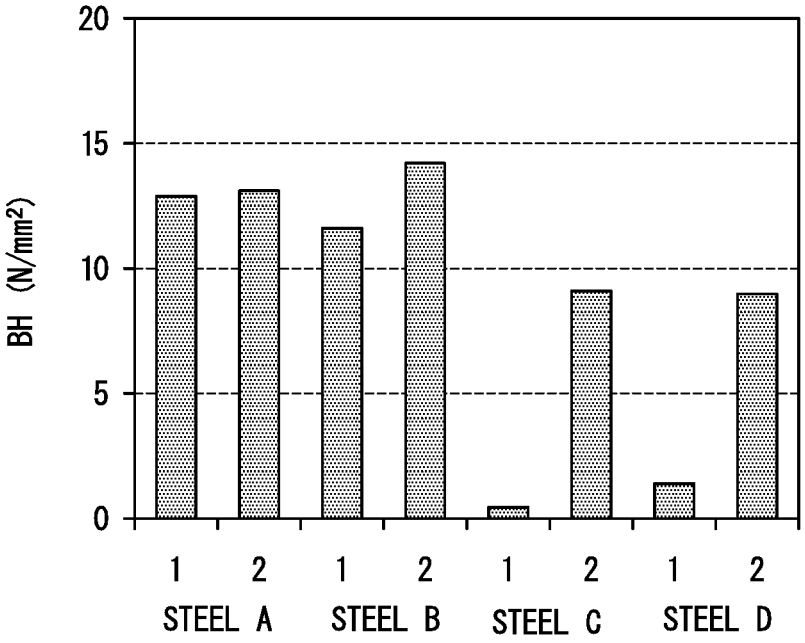
20
15
10
5
0
BH (N/mm²)
1
2
1
2
1
2
1
2
STEEL A
STEEL B
STEEL C
STEEL D

FERRITIC STAINLESS STEEL SHEET EXHIBITING SMALL INCREASE IN STRENGTH AFTER AGING HEAT TREATMENT, AND METHOD OF PRODUCING THE SAME

TECHNICAL FIELD

The present invention relates to a ferritic stainless steel sheet exhibiting small increase in strength after aging heat treatment, and a method of producing the same. Particularly, the present invention relates to a ferritic stainless steel sheet capable of suppressing strengthening by performing aging heat treatment on a steel sheet such as ferritic stainless steel generally containing a large amount of Cr, and a method of producing the same.

Priority is claimed on Japanese Patent Application No. 2013-52423, filed Mar. 14, 2013, the content of which is incorporated herein by reference.

BACKGROUND ART

Since ferritic stainless steel has excellent corrosion resistance, it is used for various applications such as a kitchen or the like. In the case of stainless steel, the states of C and N present in the steel and corrosion resistance are closely connected. That is, when C and N are present in a solid solution state in the steel, Cr carbonitrides are formed during heat treatment or in a cooling process after welding to form a Cr-depleted layer in the vicinity of the Cr carbonitrides, and thereby deterioration of corrosion resistance, so-called "sensitization", occurs in some cases. In order to suppress such sensitization, in the producing of stainless steel, countermeasures have been taken to reduce the amounts of solid-soluted C and solid-soluted N in grains by reducing the amounts of C and N as much as possible and by adding an element having higher carbonitride-forming capability (such as Nb or Ti) than that of Cr. As described above, the ferritic stainless steel is used to produce a steel sheet in which the amounts of solid-soluted C and solid-soluted N are reduced as much as possible.

On the other hand, it is known that the solid-soluted C and N remaining in the grains affect properties of the material after aging. In low-carbon steel, a Bake-Hardening (BH) phenomenon occurs in which the strength of the material is increased by performing heat treatment on the low-carbon steel at a low temperature after strain is applied to the steel in some cases. It has been considered that BH occurs due to the following. The solid-soluted C (N) remaining in grains is fixed to dislocation introduced by applying strain and then becomes an obstacle to dislocation movement. Therefore, the amount of stress required for deformation increases, that is, the strength of the material increases. It is known that there is a preferable correlation between the amount of C in the grains and the amount of stress increased by BH (bake-hardening amount, BH amount) A. A technology for controlling a BH amount by adjusting the amount of solid-soluted C has been developed (refer to NPL 1).

In regard to BH occurring in the steel type containing Cr, knowledges described in NPL 2 are known. NPL2 discloses that after the steel type containing Ti in an amount sufficient to fix C and N as carbonitrides (18Cr-0.197Ti-0.0028C-0.0054N steel) is subjected to tension of 7.5% and then to aging at 200° C. for 30 minutes, the aging index thereof is higher than 10 MPa. This result shows that even when Ti is added in an amount sufficient to fix C and N as precipitates in the stainless steel, the solid-soluted C or N is present therein.

As described above, as a countermeasure to sensitization of a ferritic stainless thin steel sheet, a method has been adopted, in which the amounts of solid-soluted C and solid-soluted N are reduced in grains by reducing the amounts of C and N as much as possible, and adding an element having higher carbonitride formation capability (such as Nb or Ti) than that of Cr. However, as disclosed in NPL 2, even when a sufficient amount of Ti is added, solid-soluted C or N remains in some cases.

Here, such a ferritic stainless thin steel sheet is subjected to cold rolling, annealing, and then skin-pass rolling in many cases. When this steel sheet is worked after being stored for a long period of time under the environment of relatively high temperature (approximately to 50° C.), a wrinkle-like shape (stretcher strain) is formed due to the occurrence of a yield point, which causes a problem in some cases. The stretcher strain is a surface defect occurring because a part of dislocation is already fixed by the solid-soluted C and solid-soluted N before processing (before strain is applied) (natural aging) to cause yield point elongation at the time of processing. The stretcher strain causes a problem in that product properties are remarkably deteriorated. In addition, since the stretcher strain spoils the outer appearance, polishing is required to remove the stretcher strain. Thus, it is important to suppress the occurrence of stretcher strain.

That is, solid-soluted C or solid-soluted N remains and stretcher strain occurs even in a high purity ferritic stainless thin steel sheet to which a carbonitride-forming element such as Ti or Nb is added. Therefore, a stringent method for storing a thin steel sheet after cold rolling is used as a countermeasure.

On the other hand, as a technique for increasing various properties by defining the details of a heat treatment condition in ferritic stainless steel to which Sn is added, techniques in PTLs 1 to 3 are known.

PTL 1 discloses a method to obtain a steel sheet satisfying both corrosion resistance and workability by revising the finish annealing conditions. PTL 2 discloses a method to obtain a steel sheet having excellent rust resistance by controlling a dew point and atmosphere at the time of finish annealing. PTL 3 discloses a method to obtain a steel sheet having excellent oxidation resistance and high temperature strength by defining conditions for hot-rolled sheet annealing and cooling after annealing.

CITATION LIST

Patent Literature

[PTL 1] Japanese Unexamined Patent Application, First Publication No. 2009-174036

[PTL 2] Japanese Unexamined Patent Application, First Publication No. 2010-159487

[PTL 3] Japanese Unexamined Patent Application, First Publication No. 2012-172161

Non-Patent Literature

[NPL 1] Atsuki Okamoto, Kouichi Takeuchi, "Sumitomo Metals" Vol. 41, No. 2 (1989) pp. 195-206

[NPL 2] "Characteristics of High Purity Fe—Cr Alloy" (edited by High Purity Fe—Cr Alloy Research Department of Special Base Research Association of The Iron and Steel Institute of Japan, (1995) pp. 54-59)

SUMMARY OF INVENTION

Technical Problem

In the above-described findings of the background art and PTLs 1 to 3, it is difficult to suppress stretcher strain in ferritic stainless steel sheets and a description of a technique for suppressing stretcher strain has not been made.

Here, an object of the present invention is to provide a stainless steel sheet exhibiting small increase in strength after aging heat treatment, and a method of producing the same, which can suppress stretcher strain occurring when being held at a high temperature for a long period of time by controlling the component system of steel and each condition of a producing method.

Solution to Problem

In order to solve the above-described problems, the inventors investigated the effects of steel components on stretcher strain occurring after aging. In the investigation, when stretcher strain occurred, a yield phenomenon was clearly observed. Therefore, the inventors investigated to what extent the amount of strength (yield strength) increased after aging, that is, BH amount is required to be reduced in order to limit stretcher strain.

A 1.0 mm-thickness cold-rolled steel sheet of high purity ferritic stainless steel was prepared, the steel in which the amount of C was changed in the range of 0.0005% to 0.020% in steel having a chemical composition of 16Cr—C. The heat treatment temperature and time in the final annealing were changed to adjust the metallographic structure (the amount of solid-soluted C). Thereby, samples were prepared. Tensile test pieces were taken from these samples in a direction parallel to a rolling direction, and subjected to prestrain imparting tensile deformation with 7.5% of strain. Then, the test pieces were subjected to heat treatment (aging heat treatment) at 200° C. for 30 minutes, and then subjected to tension again. The yield strength was measured. In addition, it was investigated whether stretcher strain was observed, using the test pieces after being subjected to tension again.

As a result, it was confirmed that stretcher strain was not observed when a relationship between stress σ1 ($N/mm^2$) after prestrain imparting tensile deformation with 7.5% of strain and upper yield stress σ2 ($N/mm^2$) when the test pieces were subjected to heat treatment at 200° C. for 30 minutes and then to tension again after the tensile deformation satisfied the following Equation (2).

$$\sigma 2-\sigma 1 \leq 8 \quad (2)$$

That is, it was confirmed that the BH amount after imparting the above prestrain and being subjected to aging heat treatment, that is, the value of σ2−σ1 might be adjusted to be 8 ($N/mm^2$) or less, in order to prevent the occurrence of stretcher strain after aging heat treatment.

Next, the component system (steel composition) to reduce the BH amount and a producing method were investigated. Generally, it is known that the BH amount is correlated with the amount of solid-soluted C, and the amount of solid-soluted C can be reduced by adding a carbide-forming element (Ti or Nb). Therefore, changes in BH amount due to change of producing processes was investigated using 17Cr-0.003C-0.006N-0.10Ti steel (Steel A), 17Cr-0.003C-0.006N-0.19Nb steel (Steel B), and steel types obtained by respectively adding 0.2% of Sn to Steel A and Steel B (Steel C and Steel D, respectively).

Using Steels A to D, respective 0.8 mm cold-rolled steel sheets were prepared and then subjected to finish annealing at the annealing temperature of 900° C., and the BH amount was measured in the same manner as in the above description. Two types of producing processes were performed. In process 1, a hot-rolled sheet annealing was performed after hot rolling. In process 2, cold rolling was performed without annealing after hot rolling. The relationship among steel types, producing processes, and BH amount was shown in FIG. 1. The numbers "1" and "2" marked on the horizontal axis in the drawing indicate "Process 1" and "Process 2" of the producing processes.

Both Steel A and Steel B had a BH amount as large as 10 $N/mm^2$ in all processes. On the other hand, the BH amounts of Steel C and Steel D could be suppressed to less than 8 $N/mm^2$ in Process 1 requiring hot-rolled sheet annealing.

Further, the effect of the producing condition by which the BH amount is affected was investigated using Steel C. As a result, it was confirmed that the BH amount was largely dependent on conditions for finish rolling at the time of hot rolling and hot-rolled sheet annealing performed thereafter.

The gist of the present invention accomplished based on the above findings obtained from the investigation conducted by the inventors is as follows.

(1) A ferritic stainless steel sheet exhibiting small increase in strength after aging heat treatment including, as a steel composition, by mass %: C: 0.020% or less; Si: 0.01% to 2.0%; Mn: 2.0% or less; P: less than 0.050%; S: less than 0.010%; Cr: 10.0% to 25.0%; N: 0.020% or less; Sn: 0.010% to 0.50%; one or more of Ti: 0.60% or less, Nb: 0.60% or less, V: 0.60% or less, and Zr: 0.60% or less so as to satisfy the following Equation (1); and a balance substantially consisting of Fe and inevitable impurities, in which stress σ1 ($N/mm^2$) after prestrain imparting tensile deformation with 7.5% of strain and upper yield stress σ2 ($N/mm^2$) when the steel sheet is subjected to a heat treatment at 200° C. for 30 minutes and then to tension again after the prestrain imparting tensile deformation satisfy the following Equation (2).

$$(Ti/48+V/51+Zr/91+Nb/93)/(C/12+N/14) \geq 1.0 \quad (1)$$

$$\sigma 2-\sigma 1 \leq 8 \quad (2)$$

In Equation (1), each element name represents the amount (mass %) thereof. In addition, in Equation (1), the amount of an element not contained in the steel is substituted by 0.

(2) The ferritic stainless steel sheet exhibiting small increase in strength after aging heat treatment according to (1), further including, by mass %, Al: 0.003% to 1.0%.

(3) The ferritic stainless steel sheet exhibiting small increase in strength after aging heat treatment according to (1) or (2), further including, by mass %, one or more of, Ni: 0.01% to 2.0%, Cu: 0.01% to 2.0%, and Mo: 0.01% to 2.0%.

(4) The ferritic stainless steel sheet exhibiting small increase in strength after aging heat treatment according to any one of (1) to (3), further including, by mass %, one or more of, B: 0.0003% to 0.0025%, Mg: 0.0001% to 0.0030%, Ca: 0.0003% to 0.0030%, Sb: 0.001% to 0.50%, Ga: 0.0003% to 0.1%, REM (rare earth metal): 0.002% to 0.2%, and Ta: 0.005% to 0.50%.

(5) A method of producing a ferritic stainless steel sheet exhibiting small increase in strength after aging heat treatment including: a hot rolling process of performing finish rolling, which is performed subsequent to rough rolling and includes plural passes, at a total rolling reduction of 40% or more of the last three passes in the finish rolling and rolling temperature of 950° C. or lower of the last pass in the finish rolling, and performing coiling treatment at 500° C. or lower after the finish rolling; and a hot-rolled sheet annealing process of heating the steel sheet to 850° C. to 1,100° C. at a heating rate of 3° C./s or more in a range from 500° C. to 700° C., and then performing heat treatment at a cooling rate of 50° C./s or less in a range from 850° C. to 550° C. after the hot rolling process, in which the method is used when a ferritic stainless steel sheet includes, as a steel composition, by mass %, C: 0.020% or less, Si: 0.01% to 2.0%, Mn: 2.0% or less, P: less than 0.050%, S: less than 0.010%, Cr: 10.0% to 25.0%, N: 0.020% or less, Sn: 0.010% to 0.50%, one or more of Ti: 0.60% or less, Nb: 0.60% or less, V: 0.60% or less, and Zr: 0.60% or less so as to satisfy the following Equation (3), and a balance substantially consisting of Fe and inevitable impurities, is produced.

$$(Ti/48+V/51+Zr/91+Nb/93)/(C/12+N/14)\geq 1.0 \quad (3)$$

In Equation (3), each element name represents the amount (mass %) thereof. In addition, in Equation (3), the amount of an element not contained in the steel is substituted by 0.

(6) The method of producing a ferritic stainless steel sheet exhibiting small increase in strength after aging heat treatment according to (5), in which the reheating temperature of a slab having the steel composition before the hot rolling process is set to 1,100° C. or higher.

(7) The method of producing a ferritic stainless steel sheet exhibiting small increase in strength after aging heat treatment according to (5) or (6), in which the steel sheet further includes, by mass %, Al: 0.003% to 1.0% as the steel composition.

(8) The method of producing a ferritic stainless steel sheet exhibiting small increase in strength after aging heat treatment according to any one of (5) to (7), in which the steel sheet further includes, by mass %, one or more of Ni: 0.01% to 2.0%, Cu: 0.01% to 2.0%, and Mo: 0.01% to 2.0% as the steel composition.

(9) The method of producing a ferritic stainless steel sheet exhibiting small increase in strength after aging heat treatment according to any one of (5) to (8), in which the steel sheet further includes, by mass %, one or more of B: 0.0003% to 0.0025%, Mg: 0.0001% to 0.0030%, Ca: 0.0003% to 0.0030%, Sb: 0.001% to 0.50%, Ga: 0.0003% to 0.1%, REM (rare earth metal): 0.002% to 0.2%, and Ta: 0.005% to 0.50% as the steel composition.

Advantageous Effects of Invention

According to the present invention, it is possible to provide a ferritic stainless steel sheet exhibiting small increase in strength after aging heat treatment, and a method of producing the same, which can effectively limit stretcher strain occurring when being held at a high temperature for a long period of time by controlling the component system of steel and each condition of a producing method.

BRIEF DESCRIPTION OF DRAWINGS

FIG. 1 is a graph showing a relationship among steel components (A: Ti-based steel, B: Nb-based steel, C: Ti—Sn-based steel, D: Nb—Sn-based steel) and the presence of hot-rolled sheet annealing (1: presence, 2: absence), and BH amount.

DESCRIPTION OF EMBODIMENTS

Hereinafter, a ferritic stainless steel sheet according to this embodiment and a method of producing the same will be described.

The ferritic stainless steel sheet of the embodiment includes, as a steel composition, by mass %, C: 0.020% or less, Si: 0.01% to 2.0%, Mn: 2.0% or less, P: less than 0.050%, S: less than 0.010%, Cr: 10.0% to 25.0%, N: 0.020% or less, Sn: 0.010% to 0.50%, one or more of Ti: 0.60% or less, Nb: 0.60% or less, V: 0.60% or less, and Zr: 0.60% or less so as to satisfy the following Equation (1), and a balance substantially consisting of Fe and inevitable impurities, in which stress $\sigma 1$ ($N/mm^2$) after prestrain imparting tensile deformation with 7.5% of strain and upper yield stress $\sigma 2$ ($N/mm^2$) when the steel sheet is subjected to a heat treatment at 200° C. for 30 minutes and then to tension again after the tensile deformation with 7.5% of strain satisfy the relationship of the following Equation (2).

$$(Ti/48+V/51+Zr/91+Nb/93)/(C/12+N/14)\geq 1.0 \quad (1)$$

$$\sigma 2-\sigma 1\leq 8 \quad (2)$$

In Equation (1), each element name represents the amount (mass %) thereof. In addition, in Equation (1), the amount of an element not contained in the steel is substituted by 0.

In the following description, first, the reason for limiting the component elements of the ferritic stainless steel sheet of the embodiment and the reason for limiting strength after aging heat treatment will be described. In the composition, the notation of % means mass % unless otherwise noted.

<C: 0.020% or Less>

Since C is an element that causes stretcher strain, the smaller the amount of C is, the more preferable it is. However, when the amount of C is excessively reduced, costs at the steelmaking stage are increased. Therefore, it is preferable to set the lower limit thereof to 0.0005%. From the viewpoint of stable producibility, the amount of C is more preferably set to 0.0015% or more and still more preferably set to 0.0025% or more. In addition, when a large amount of C is added, stretcher strain is likely to occur and the amount of an element to be added for fixing C as carbides is also increased to cause an increase in raw material cost. Therefore, the upper limit is set to 0.020%. From the viewpoint of stable producibility, the amount of C is preferably set to 0.0080% or less and more preferably set to 0.0060% or less.

<Si: 0.01% to 2.0%>

Si is utilized as a deoxidation element or is positively added for improving oxidation resistance in some cases. Since excessive lowering of Si increases costs, the lower limit thereof is set to 0.01%. From these viewpoints, the amount of Si is preferably set to 0.05% or more and more preferably set to 0.10% or more. Further, addition of a large amount of Si hardens the material and deteriorates toughness at the time of producing. Therefore, the upper limit is set to 2.0%. From the viewpoint of workability and stable producibility, the amount of Si is preferably set to 0.50% or less and more preferably set to 0.30% or less.

<Mn: 2.0% or Less>

Mn is utilized as a deoxidation element in some cases, similar to Si. Since excessive lowering of Mn increases costs, it is preferable to set the lower limit thereof to 0.01%. From these viewpoints, the amount of Mn is more preferably set to 0.05% or more and still more preferably set to 0.10% or more. In addition, addition of a large amount of Mn hardens the material and deteriorates corrosion resistance. Therefore, the upper limit is set to 2.0%. From the viewpoint of workability and stable producibility, the amount of Mn is preferably set to 0.50% or less and more preferably set to 0.30% or less.

<P: Less than 0.050%>

P is mixed into the steel as an impurity element from raw materials in some cases. The smaller the amount of P is, the more preferable it is. When a large amount of P is present, secondary workability is deteriorated. Therefore, the upper limit is limited to less than 0.050%. From the viewpoint of suppressing deterioration of workability, the amount of P is preferably set to 0.035% or less and more preferably set to less than 0.030%. On the other hand, it is not required to particularly set the lower limit of the amount of P. However, excessive lowering of P increases raw material costs and steelmaking costs. For this reason, the lower limit is preferably set to 0.005%, and the amount of P is more preferably set to 0.010% or more.

<S: Less than 0.010%>

Since S is an element that deteriorates corrosion resistance, the smaller the amount of S is, the more preferable it is. Therefore, the upper limit is limited to less than 0.010%. In addition, the smaller the amount of S is, the better corrosion resistance is. Thus, the amount of S is preferably set to less than 0.0030% and more preferably set to less than 0.0010%. On the other hand, since excessive lowering of S increases refining costs, the lower limit is preferably set to 0.0002%, and the amount of S is more preferably set to 0.0005% or more.

<Cr: 10.0% to 25.0%>

Cr is a very important element for ensuring corrosion resistance, and 10.0% or more of Cr is required to obtain stable corrosion resistance by forming a passive film. From the viewpoint of corrosion resistance and stable producibility, the amount of Cr is preferably set to 12.0% or more, more preferably set to 13.5% or more, and still more preferably set to 15.5% or more.

On the other hand, since addition of a large amount of Cr deteriorates toughness at the time of producing, the upper limit is set to 25.0%. From the viewpoint of stable producibility including toughness, the amount of Cr is preferably set to 22.0% or less, more preferably set to 19.3% or less, and still more preferably set to 18.0% or less.

<N: 0.020% or Less>

Since N is an element that causes stretcher strain similar to C, the smaller the amount of N is, the more preferable it is.

However, since excessive lowering of N increases costs at a steelmaking stage, the lower limit thereof is preferably set to 0.0005%. From the viewpoint of stable producibility, the amount of N is more preferably set to 0.0015% or more and still more preferably set to 0.0030% or more. In addition, when a large amount of N is added, stretcher strain is likely to occur and the amount of an element added for fixing N as nitrides is increased to cause an increase in raw material cost. Therefore, the upper limit is set to 0.020%. From the viewpoint of stable producibility, the amount of N is preferably set to 0.015% or less and more preferably set to 0.010% or less.

<Sn: 0.010% to 0.50%>

Sn is an important element in the embodiment and has an effect of reducing the BH amount after aging and preventing the occurrence of stretcher strain. In order to exhibit this effect, it is required to contain 0.010% or more of Sn and thus 0.010% is set as a lower limit. In order to more stably ensure the effect, the amount of Sn is preferably set to 0.05% or more and more preferably set to 0.08% or more. In addition, since addition of 0.50% of Sn saturates the above-described effect of reducing BH, 0.50% is set as an upper limit. Considering raw material cost and stability for reducing BH, the amount of Sn is preferably set to 0.30% or less and more preferably set to 0.22% or less.

<One or More of Ti, Nb, V, and Zr>

In the embodiment, these elements are required to fix C and N as precipitates and added so as to satisfy the following Equation (1).

$$(Ti/48+V/51+Zr/91+Nb/93)/(C/12+N/14)\geq 1.0 \quad (1)$$

When Equation (1) is not satisfied, sufficient amounts of C and N are not fixed as precipitates. Therefore, the amounts of solid-soluted C and solid-soluted N remaining are increased and the BH amount is increased. Therefore, it is required to satisfy this equation.

In addition, the lower limit of the addition amount of each element of Ti, Nb, V, and Zr is preferably set to 0.03%. When the amount of each element is more than 0.03%, the effect is exhibited. In order to more stably obtain the effect, it is more preferable to add 0.08% or more of each element. On the other hand, from the viewpoint of forming carbides, the upper limit is determined by the amounts of C and N. However, since addition of large amounts of these elements hardens the material and deteriorates workability in some cases, the upper limit of each element is set to 0.60%. The upper limit is more preferably set to 0.45% or less.

Further, in the embodiment, in addition to the above-described elements, it is preferable to add Al: 0.003% to 1.0%.

Al is used as a deoxidation element in some cases and Al is known to improve oxidation resistance. Thus, Al may be added as required. The amount of Al effective for deoxidation is 0.003% and it is preferable to set 0.003% as a lower limit. In addition, when the amount of Al is more than 1.0%, the amount of strengthening is increased and formability may be deteriorated. Therefore, it is preferable to set 1.0% as an upper limit. A preferable range of the amount of Al is 0.005% to 0.15% in order to exhibit a certain degree of deoxidation effect and not to significantly lower formability.

Further, in the embodiment, in addition to the above-described elements, it is preferable to add one or more of Ni: 0.01% to 2.0%, Cu: 0.01% to 2.0%, and Mo: 0.01% to 2.0%.

These elements of Ni, Cu and Mo are elements that improve corrosion resistance and may be added as required. When 0.01% or more of each element is added, the effect is exhibited. Therefore, it is preferable to set the lower limit of each element to 0.01% or more. In addition, since addition of large amounts of the elements hardens the material and deteriorates ductility, it is preferable to set 2.0% as an upper limit of each of Ni, Cu and Mo. From the viewpoint of exhibiting corrosion resistance and ensuring quality of material, a more preferable addition range of Ni and Cu is set to 0.05% to 0.60%, and a more preferable addition range of Mo is set to 0.20% to 1.30%. A still more preferable range of Ni and Cu is set to 0.10% to 0.30%, and a still more preferable range of Mo is set to 0.30% to 0.60%.

Further, in the embodiment, in addition to the above-described elements, it is preferable to add one or more of B: 0.0003% to 0.0025%, Mg: 0.0001% to 0.0030%, Ca: 0.0003% to 0.0030%, Sb: 0.001% to 0.50%, Ga: 0.0003% to 0.1%, REM (rare earth metals): 0.002% to 0.2%, and Ta: 0.005% to 0.50%.

B, Mg and Ca are elements having an effect of improving secondary workability and ridging resistance. Since the effect is exhibited when the amount of B is 0.0003% or more, the amount of Mg is 0.0001% or more, and the amount of Ca is 0.0003% or more, it is preferable to set these values as lower limits thereof. On the other hand, when a large amount of the elements is reduced, a yield rate at the time of producing is decreased in some cases. Therefore, it is preferable to set the upper limit of the amount of B to 0.0025% and the upper limits of Mg and Ca to 0.0030%. A more preferable addition range of B and Ca is set to 0.0003% to 0.0010%, and a more preferable addition range of Mg is set to 0.0002% to 0.0008%.

Sb is effective for improving corrosion resistance and 0.50% or less of Sb may be added as required. Particularly, from the viewpoint of crevice corrosiveness, the lower limit of the amount of Sb is set to 0.001%. From the viewpoint of producibility and costs, it is preferable to set the lower limit to 0.01%. From the viewpoint of costs, it is preferable to set the upper limit to 0.1%.

0.1% or less of Ga may be added to improve corrosion resistance and suppress hydrogen embrittlement. From the viewpoint of forming sulfides, the lower limit is set to 0.0003%. From the viewpoint of producibility and costs, the amount of Ga is preferably set to 0.0010% or more. The amount of Ga is more preferably set to 0.0020% or more.

REM (rare earth metal) is an element that exhibits an effect of improving oxidation resistance and adhesion of an oxide film. In order to exhibit the effect, the lower limit thereof is preferably set to 0.002% or more. Since the effect is saturated with 0.2% of REM, this value is set as an upper limit of the amount of REM (rare earth metal). According to a general definition, REM (rare earth element) is the general term of elements consisting of 2 elements of scandium (Sc) and yttrium (Y) and 15 elements (lanthanoids) from lanthanum (La) to lutetium (Lu). REM (rare earth element) may be added alone or a mixture thereof may be added, within a range of 0.002% to 0.2%.

Ta is an element that improves high temperature strength and may be added as required. In order to obtain the effect, 0.005% or more of Ta is added. However, since excessive addition of Ta deteriorates ductility at normal temperature and toughness, 0.50% is set as an upper limit. In order to satisfy high temperature strength, ductility, and toughness, the amount of Ta is preferably 0.05% or more and 0.50% or less.

Components other than the above-described components are not particularly defined in the present invention. However, in the present invention, Hf, Bi and the like may be added in an amount of 0.001% to 0.1% as required. It is preferable to reduce the amount of a generally harmful element such as As or Pb and an impurity element as much as possible.

The steel composition (component elements) and the reason for limiting the steel composition have been described above. However, the balance of the ferritic stainless steel sheet according to the embodiment excluding the above-described elements substantially consists of Fe and inevitable impurities. In the embodiment, a trace amount of an element that does not impair the effects of the present invention including inevitable impurities may be added.

In the ferritic stainless steel sheet having the above-described steel composition, the relationship between stress $\sigma 1$ ($N/mm^2$) after prestrain imparting tensile deformation with 7.5% of strain and upper yield stress $\sigma 2$ ($N/mm^2$) when the steel sheet is subjected to a heat treatment at 200° C. for 30 minutes and then to tension again after the tensile deformation satisfies the relationship of the following Equation (2). Here, $\sigma 1$ indicates stress when 7.5% of strain is applied. In a tensile test, strain increases and stress changes gradually in a deformation process. $\sigma 1$ indicates the stress when strain reaches 7.5%. In the above-described tensile deformation, JIS 13B tensile test pieces according to JIS Z 2241: 2011 (corresponding to ISO 6892-1: 2009) are used as tensile test pieces, and the tension rate during the tensile test is set to in a range of 1 mm/min to 3 mm/min. Other conditions are set according to JIS Z 2241.

$$\sigma 2-\sigma 1 \leq 8 \quad (2)$$

When Equation (2) is not satisfied, stretcher strain occurs during forming (processing). Therefore, it is important to satisfy Equation (2).

The reason why stretcher strain does not occur when the relationship satisfies Equation (2) is not clear. However, it can be considered that the behavior of C in the steel is changed since the steel has the above-described steel composition, particularly, contains Sn. It is known that Sn does not react with C to form a compound and rather exhibits a repulsive interaction with C. In addition, C and Sn are known as elements that have a strong tendency to segregate on the grain boundaries. Considering these facts, it is considered that when Sn is present at the grain boundaries, precipitation of C is promoted and the amount of solid-soluted C causing stretcher strain is reduced.

Next, a method of producing the ferritic stainless steel sheet according to the embodiment will be described.

The method of producing the ferritic stainless steel sheet according to the embodiment includes: a hot rolling process of performing finish rolling, which is performed subsequent to rough rolling and includes plural passes, at a total rolling reduction of 40% or more of the last three passes in the finish rolling and rolling temperature of 950° C. or lower of the last pass in the finish rolling, and performing coiling treatment at 500° C. or lower after the finish rolling; and a hot-rolled sheet annealing process of heating the steel sheet to 850° C. to 1,100° C. at a heating rate of 3° C./s or more in a range from 500° C. to 700° C., and then performing heat treatment at a cooling rate of 50° C./s or less in a range from 850° C. to 550° C. after the hot rolling process, and the method is used when a ferritic stainless steel sheet having the above-described steel composition, that is, including, as a steel composition, C: 0.020% or less, Si: 0.01% to 2.0%, Mn: 2.0% or less, P: less than 0.050%, S: less than 0.010%, Cr: 10.0% to 25.0%, N: 0.020% or less, Sn: 0.010% to 0.50%, one or more of Ti: 0.60% or less, Nb: 0.60% or less, V: 0.60% or less, and Zr: 0.60% or less so as to satisfy the following Equation (3), and a balance substantially consisting of Fe and inevitable impurities, is produced:

$$(Ti/48+V/51+Zr/91+Nb/93)/(C/12+N/14) \geq 1.0 \quad (3)$$

In Equation (3), each element name represents the amount (mass %) thereof. In addition, in Equation (3), the amount of an element not contained in the steel is substituted by 0.

Hereinafter, each producing condition will be described in detail.

"Heating steel piece to 1,100° C. or higher in hot rolling process"

First, steel having the above-described steel composition is prepared and then is subjected to casting to obtain a steel piece (slab).

Subsequently, a hot rolling process is performed. In the embodiment, it is preferable that the reheating temperature of the steel piece be set to 1,100° C. or higher before the hot rolling process. When the reheating temperature is lower than 1,100° C., a rolling load may increase in the hot rolling to cause flaws at the time of rolling. Therefore, it is preferable to set to 1,100° C. as a lower limit temperature. On the other hand, when the reheating temperature is excessively high, the steel piece may be softened to cause a shape change. Therefore, it is preferable to set the upper limit temperature to 1,250° C. From the viewpoint of the rolling load and the shape of the steel piece, a particularly preferable range of the reheating temperature is 1,150° C. to 1,200° C.

"Setting total rolling reduction of last three passes of finish rolling to 40% or more and setting rolling temperature of last pass of finish rolling to 950° C. or lower"

After the above-described steel piece is reheated, a hot rolling process is performed on the steel piece. The hot rolling process is approximately composed of rough rolling, finish rolling including plural passes, specifically, 3 or more passes, and a subsequent coiling process. In the embodiment, in the finish rolling, a total rolling reduction of the last three passes is set to 40% or more and the rolling temperature of the last pass in the finish rolling is set to 950° C. or lower. It is important to perform the coiling process at a coiling temperature of 500° C. or lower after the finish rolling.

Each condition of these processes will be described.

In regard to rolling reduction of the finish rolling, the total rolling reduction of the last three passes (hereinafter, also simply referred to as a total rolling reduction) is set to 40% or more. In the embodiment, it is important to subject the steel piece to a high rolling reduction to increase the number of recrystallization nuclei, thereby reducing the size of recrystallized grains. The reason for limiting the rolling reduction will be described later. By increasing the rolling reduction, the number of recrystallization nuclei can be sufficiently ensured and the size of recrystallized grains is reduced in the subsequent annealing process so that boundary segregation of Sn can be promoted. As a result, it is considered that the BH amount can be reduced. However, when the total rolling reduction is less than 40%, the number of recrystallization nuclei cannot be sufficiently ensured. As a result, since the BH amount is increased, the total rolling reduction is set to 40% or more. From the viewpoint of increasing the number of recrystallization nuclei, the lower limit of the total rolling reduction is preferably set to 45%. In addition, the upper limit of the total rolling reduction is not particularly defined. However, in consideration of a load at the time of rolling, it is preferable to set the upper limit to 80%. The total rolling reduction X of the last three passes can be obtained by the following Equation (4) based on the relationship between the final thickness tf (mm) and the thickness before the last three passes ty (mm).

$$X=100\times(1-tf/ty)(\%) \quad (4)$$

The reason for setting the total rolling reduction of the last three passes to 40% or more will be described. The rolling temperature of the last three passes in the finish rolling is low compared to other passes and strain is easily accumulated. Therefore, the total rolling reduction of the last three passes significantly affects recrystallization in the subsequent annealing process, and the BH amount varies significantly depending on the total rolling reduction. That is, in the last three passes in which the rolling temperature is relatively low, the amount of accumulated strain is large and as a result, the number of recrystallization nuclei can be increased. When recrystallization is carried out by hot-rolled sheet annealing as a post process in a state in which the recrystallization nuclei are ensured in this manner, recrystallized grains (recrystallized structure) can be made finer (the size of recrystallized grains can be reduced). As a result, the BH amount can be reduced. Although a mechanism capable of reducing the BH amount by making recrystallized grains finer as described above is not clear at present, it can be considered as follows. That is, the area of the grain boundary which is a segregation site of Sn of a boundary segregation element can be increased by making recrystallized grains finer. As a result, the diffusion length of Sn is decreased and segregation of Sn to the grain boundary is promoted. Therefore, segregation of C to the grain boundary is suppressed while precipitation of C is promoted, thereby reducing the amount of solid-soluted C. As a result, it is considered that an increase in the BH amount can be suppressed.

Further, in the embodiment, from the viewpoint of ensuring recrystallization nuclei as described above, the rolling temperature at the last stage of the finish rolling is set to 950° C. or lower. This is because when the temperature is higher than 950° C., the BH amount increases and stretcher strain occurs. It is preferable to set the lower limit of the rolling temperature at the last stage (the last pass) in the finish rolling to 780° C. from the viewpoint of preventing the occurrence of flaws at the time of rolling.

"Coiling temperature of 500° C. or lower"

In addition, in the embodiment, from the viewpoint of ensuring recrystallization nuclei as described above, the coiling temperature is also a very important requirement. When the coiling temperature is higher than 500° C., recrystallized grains (recrystallized structure) are coarsened (the size of recrystallized grains is excessively increased) at the time of hot-rolled sheet annealing as a post process. As a result, the BH amount is increased. Therefore, the coiling temperature is set to 500° C. or lower. The coiling temperature is preferably set to 450° C. or lower. On the other hand, when the coiling temperature is excessively lowered, it is difficult to control temperature at the time of coiling. Also, special equipment is required. Therefore, it is preferable to set the lower limit of the coiling temperature to 250° C. or lower.

As described above, in the hot rolling process according to the embodiment, it is required to define the total rolling reduction of the last three passes at the time of finish rolling, the finish rolling temperature, and the coiling temperature in order to reduce the BH amount.

"Setting a heating rate to 3° C./s or more in range from 500° C. to 700° C., setting temperature reaching after heating to 850° C. to 1,100° C., and setting a cooling rate to 50° C./s or less in range from 850° C. to 550° C. in hot-rolled sheet annealing"

After the hot rolling process, hot-rolled sheet annealing is performed, in which the steel sheet is heated to 850° C. to 1,100° C. at a heating rate of 3° C./s or more in a range from 500° C. to 700° C., and then heat treatment is performed at a cooling rate of 50° C./s or less in a range from 850° C. to 550° C.

In the hot-rolled sheet annealing process, first, the hot-rolled sheet is heated to a reaching temperature which will be described later to increase the temperature. In the embodiment, the heating rate in a range from 500° C. to 700° C. is set to 3° C./s or more. When the heating rate is less than 3° C./s, recrystallized grains are coarsened at the time of hot-rolled sheet annealing as a post process and sufficient BH cannot be obtained. The heating rate is preferably 5° C./s or more and more preferably 10° C./s or more. When the heating rate is more than 20° C./s, the effect saturates. Therefore, it is preferable to set this value as the upper limit of the heating rate.

In addition, the reaching temperature after heating (temperature rise) is an important requirement to recrystallize recrystallization nuclei ensured by the finish rolling. In the embodiment, the reaching temperature is set to 850° C. to 1,100° C. When the reaching temperature is lower than 850° C., recrystallization is not sufficient and an effect of reducing the BH amount cannot be sufficient. In addition, the workability and ridging characteristics of a cold rolling-annealed sheet are deteriorated. Therefore, it is important to increase the temperature to 850° C. or higher. From the viewpoint of forming a recrystallized structure, it is preferable to set the reaching temperature to 900° C. or higher. Further, when the reaching temperature is higher than 1,100° C., the grains of the steel sheet are coarsened and the formability and surface characteristics (surface roughening properties) of a product sheet are deteriorated. Therefore, the reaching temperature is set to 1,100° C. or lower. From the viewpoint of suppressing coarsening of grains, it is preferable to set the reaching temperature to 1080° C. or lower.

In addition, the cooling rate at the time of cooling after hot-rolled sheet annealing is an important requirement to make recrystallized grains finer. In the embodiment, the cooling rate is controlled to be 50° C./s or less in a range from 850° C. to 550° C. in the cooling process after hot-rolled sheet annealing. When the cooling rate exceeds 50° C./s, recrystallized grains is not made fine sufficiently and the BH amount is increased. Therefore, the cooling rate is set to 50° C./s or less. From the viewpoint for making recrystallized grains fine, the cooling rate is preferably 15° C./s or less. On the other hand, since excessive lowering of the cooling rate deteriorates producibility, it is preferable to set the cooling rate to 5° C./s or more. Further, the cooling rate is more preferably set to more than 10° C./s to prevent toughness and pickling properties from being deteriorated due to precipitation of fine carbonitride.

Then, the hot-rolled ferritic stainless steel sheet obtained as described above is subjected to cold rolling, annealing (final annealing), and as required, skin-pass rolling. In the embodiment, since there is no difference in the effects depending on the final annealing temperature, the final annealing temperature is not particularly limited. In addition, even when the heating rate and the cooling rate are changed, the effects are not significantly changed. Thus, from the viewpoint of stretcher strain, there is no need to particularly limit them. However, since it is necessary to obtain the recrystallized structure by annealing, it is considered that a heat treatment at 800° C. or higher is required. The higher the annealing temperature is, the coarser the grains become, thereby promoting surface roughening at the time of forming. Thus, it is preferable to set the upper limit thereof to 1,050° C.

In addition, regarding a cold rolling condition, since there is no difference in the above-described effects depending on the roll roughness and roll size of a work roll to be used, rolling oils, number of rolling passes, rolling rate, rolling temperature, and cold rolling reduction, these are not particularly defined.

The above-described effects of the embodiment are also exhibited by a twice cold rolling method or a three-time cold rolling method.

Further, since the structure in the steel is controlled, the steel is not affected by the furnace atmosphere at the time of final annealing.

As described above, in a steel piece having a steel composition (component system) containing Sn, it is possible to obtain a ferritic stainless steel sheet which exhibits small increase in strength after aging heat treatment, and is capable of reducing a BH amount and effectively limiting stretcher strain, only by defining a hot rolling condition, a coiling condition, and a hot-rolled sheet annealing condition in combination.

Although a mechanism of reducing a BH amount by making recrystallized grains finer by controlling the above-described conditions of the producing method is not clear, it is considered as follows.

It is known that the BH amount is correlated with the amount of solid-soluted C. C is an element that segregates at grain boundaries and Sn also is an element that segregates at grain boundaries. The inventors consider that since Sn is considered as an element that segregates preferentially over C at grain boundaries, Sn segregates at the grain boundaries preferentially over C in the cooling process after hot-rolled sheet annealing. That is, when Sn is added to the steel, it is considered that the amount of C present at grain boundaries is reduced. Then, it is considered that since Sn is present at the grain boundaries preferentially, precipitation of C which does not segregate at the grain boundaries as carbonitrides is promoted. Accordingly, it is assumed that addition of Sn itself has an effect of reducing the amount of solid-soluted C and as a result, it is considered that the BH amount can be reduced.

In addition, in the present invention, it is necessary to perform finish hot rolling at a high rolling reduction and a low temperature, decrease a coiling temperature, and increase the heating rate and reaching temperature of hot-rolled sheet annealing. All of these conditions are producing conditions for increasing the number of recrystallization nuclei and reducing the size of recrystallized grains. Generally, the smaller the size of the recrystallized grains is, the larger the BH amount is. In the present invention, a producing condition for making the recrystallized grains finer (reducing the size of the recrystallized grains) as described above is required. Although the cause of reducing the BH amount by making the recrystallized grains finer is not clear at present, it can be considered as follows. A Sn diffusion distance is reduced by increasing the area of a grain boundary which is a segregation site of Sn, and segregation of Sn is promoted. As a result, it is considered that the amount of solid-soluted C can be reduced.

EXAMPLES

Hereinafter, the effects of the present invention will described with reference to examples. However, the present invention is not limited to the conditions used in the examples.

Molten steels having component compositions (mass %) of Tables 1 and 2 were prepared. REM (rare earth metal) in Tables 1 and 2 is a mixture of La, Ce, Pr, and Nd. Next, steel pieces having a thickness of 90 mm were cut and taken out from the obtained steel ingots and reheated to heating temperatures shown in Tables 3 to 5. Then, the steel pieces are rolled by hot rolling to have a thickness of 4.0 mm. The total rolling reduction of the last three passes of finish rolling of each steel piece is shown as X (%) and the rolling temperature of the last pass is shown as a finish rolling temperature (° C.) in Tables 3 to 5.

Thereafter, the rolled sheets were coiled at coiling temperatures shown in Tables 3 to 5 and then subjected to hot-rolled sheet annealing under various conditions shown in Tables 3 to 5. After the hot-rolled sheet annealing, the steel sheets were subjected to pickling and then cold rolling to have a thickness of 0.4 mm to 2.0 mm. Thus, cold-rolled steel sheets were obtained. The cold-rolled steel sheets were subjected to heat treatment (cold-rolled sheet annealing) at a temperature in a range of 800° C. to 1,000° C. to prepare ferritic stainless steel sheets.

Then, the ferritic stainless steel sheets were provided for BH measurement, stretcher strain determination and surface investigation after a forming test (whether or not surface roughening occurred).

The BH was measured using JIS 13B tensile test pieces based on the difference between stress σ1 ($N/mm^2$) after prestrain imparting tensile deformation with 7.5% of strain, and upper yield stress σ2 ($N/mm^2$) when the test pieces were subjected to heat treatment at 200° C. for 30 minutes and then to tension again after the prestrain imparting tensile deformation with 7.5% of strain, as described above. While setting the number of N to 2, BH was evaluated based on the average value thereof. The tension rate was set to 3 mm/min.

Stretcher strain was evaluated from the outer appearance of the JIS 13B tensile test pieces after the test pieces were subjected to prestrain imparting tensile deformation with 7.5% of strain, heat treatment at 200° C. for 30 minutes, and then deformed with 1% of strain.

In a forming test, each of the hot-rolled sheets after the hot-rolled sheet annealing was subjected to a forming test at a draw ratio of 2.0 using a cylindrical punch with Φ 50 mm, and then whether or not surface roughening occurred was determined from the outer appearance of the surface of vertical wall portions. In addition, the surface state after hot-rolling and coiling was visually observed and whether or not galling marks were present was observed.

In all of the steel sheets having the composition within the range of the present invention and the steel sheets obtained by the producing method according to the present invention, the BH amount (σ2−σ1) was as small as less than 8 ($N/mm^2$) and no stretcher strain and surface roughening were observed.

TABLE 1

| | Component composition (mass %) | | | | | | | | | | | | |
|---|---|---|---|---|---|---|---|---|---|---|---|---|---|
| Steel | C | Si | Mn | P | S | Cr | N | Sn | Ti | Nb | V | Zr | Al |
| A | 0.0021 | 0.18 | 0.08 | 0.015 | 0.001 | 16.7 | 0.0065 | 0.18 | 0.24 | | | | |
| B | 0.0050 | 0.22 | 0.25 | 0.031 | 0.002 | 17.1 | 0.0085 | 0.25 | | 0.35 | | | 0.005 |
| C | 0.0110 | 0.62 | 0.15 | 0.022 | 0.001 | 11.5 | 0.0068 | 0.03 | | 0.09 | 0.09 | 0.09 | |
| D | 0.0060 | 0.48 | 0.34 | 0.018 | 0.002 | 16.5 | 0.0095 | 0.12 | 0.06 | | 0.12 | 0.22 | 0.19 |
| E | 0.0015 | 1.81 | 0.41 | 0.013 | 0.001 | 20.3 | 0.0130 | 0.015 | 0.11 | 0.25 | 0.06 | 0.06 | |
| F | 0.0086 | 0.62 | 1.77 | 0.023 | 0.006 | 17.3 | 0.0120 | 0.34 | | | | 0.25 | 0.03 |
| G | 0.0029 | 0.13 | 0.11 | 0.027 | 0.001 | 14.3 | 0.0091 | 0.11 | 0.09 | 0.13 | | | 0.02 |
| H | 0.0016 | 0.84 | 0.26 | 0.031 | 0.002 | 19.2 | 0.0068 | 0.18 | | | 0.18 | | 0.75 |
| I | 0.0011 | 1.21 | 1.55 | 0.045 | 0.003 | 13.5 | 0.0075 | 0.24 | 0.18 | | | 0.09 | 0.22 |
| J | 0.0150 | 0.06 | 0.24 | 0.015 | 0.004 | 23.1 | 0.0167 | 0.05 | 0.06 | | 0.06 | | |
| K | 0.0180 | 0.09 | 0.38 | 0.028 | 0.005 | 16.2 | 0.0120 | 0.33 | | 0.24 | | | 0.06 |
| L | 0.0190 | 0.25 | 1.44 | 0.016 | 0.002 | 15.4 | 0.0150 | 0.12 | 0.13 | | 0.51 | 0.11 | |
| M | 0.0054 | 0.34 | 0.22 | 0.025 | 0.001 | 13.5 | 0.0099 | 0.06 | 0.11 | 0.25 | 0.08 | | 0.15 |
| N | 0.0023 | 1.11 | 0.08 | 0.035 | 0.0009 | 21.1 | 0.0123 | 0.03 | | 0.33 | | 0.22 | 0.06 |
| O | 0.0101 | 0.84 | 1.11 | 0.041 | 0.0009 | 17.1 | 0.0141 | 0.22 | 0.45 | | | | 0.008 |
| P | 0.0084 | 0.56 | 0.33 | 0.022 | 0.002 | 16.9 | 0.0087 | 0.13 | 0.25 | 0.12 | 0.11 | 0.11 | |
| Q | 0.0025 | 0.19 | 0.81 | 0.029 | 0.0018 | 19.8 | 0.0088 | 0.09 | 0.08 | 0.25 | | | 0.07 |
| R | 0.0048 | 0.32 | 0.66 | 0.029 | 0.0011 | 17.3 | 0.0094 | 0.12 | 0.09 | 0.24 | | | |
| S | 0.0039 | 1.11 | 0.22 | 0.025 | 0.0009 | 13.5 | 0.0065 | 0.21 | | 0.31 | | | |

| | Component composition (mass %) | | | | | | | | | |
|---|---|---|---|---|---|---|---|---|---|---|
| Steel | Ni | Cu | Mo | B | Mg | Ca | Sb | Ga | REM | Ta |
| A | | | | | | | | | | |
| B | | 0.12 | 1.35 | | 0.0002 | 0.0004 | | | | |
| C | 0.12 | | | 0.0003 | | | | | | |
| D | 0.25 | | | | | | | | | |
| E | | | | | | 0.0003 | | | | |
| F | 0.03 | | 0.05 | | | | | | | |
| G | | | | 0.0004 | | | | | | |
| H | 0.4 | 0.45 | | | | | | | | |
| I | | 0.05 | 0.33 | | 0.0019 | | | | | |
| J | 0.12 | | | | | 0.0019 | | | | |
| K | | | | 0.0022 | | | | | | |
| L | 1.22 | | | | | | | | | |
| M | | | | | | | 0.002 | | | |
| N | 0.22 | | | 0.0007 | | | | 0.0021 | | |
| O | | 0.35 | | | 0.0009 | 0.0011 | 0.09 | | 0.009 | |
| P | 0.11 | | | | 0.0008 | | | | | 0.008 |
| Q | | | | | | | | | | |
| R | | | | | | | | | | |
| S | | | | | | | | | | |

TABLE 2

| Steel | Component composition (mass %) | | | | | | | | | | | | |
|---|---|---|---|---|---|---|---|---|---|---|---|---|---|
| | C | Si | Mn | P | S | Cr | N | Sn | Ti | Nb | V | Zr | Al |
| T | 0.0021 | 0.41 | 0.25 | 0.027 | 0.003 | 14.1 | 0.0084 | | | 0.25 | | | 0.12 |
| U | 0.0092 | 0.62 | 0.39 | 0.028 | 0.004 | 12.4 | 0.0055 | | 0.12 | | 0.12 | | |
| V | 0.0049 | 0.30 | 0.56 | 0.029 | 0.003 | 18.6 | 0.0099 | | 0.11 | 0.05 | | 0.25 | 0.01 |
| W | 0.0122 | 0.25 | 0.25 | 0.041 | 0.0055 | 14.8 | 0.011 | 0.12 | | | | | |
| X | 0.0048 | 0.32 | 0.66 | 0.035 | 0.0025 | 17.2 | 0.0101 | 0.005 | | 0.35 | | | |

| Steel | Component composition (mass %) | | | | | | | | | |
|---|---|---|---|---|---|---|---|---|---|---|
| | Ni | Cu | Mo | B | Mg | Ca | Sb | Ga | REM | Ta |
| T | | 0.25 | | | | | | | | |
| U | | | | | | | | | | |
| V | | | 0.11 | | | | | | | |
| W | | | | | | | | | | |
| X | | | | | | | | | | |

TABLE 3

| No. | Steel | Heating temperature (° C.) | X (%) | Finish rolling temperature (° C.) | Coiling temperature (° C.) | t1 (° C./s) | Reaching temperature (° C.) | t2 (° C./s) |
|---|---|---|---|---|---|---|---|---|
| 1 | A | 1180 | 45 | 920 | 480 | 7 | 860 | 12 |
| 2 | A | 1200 | 52 | 910 | 460 | 6 | 805 | 55 |
| 3 | A | 1160 | 31 | 980 | 460 | 10 | 910 | 32 |
| 4 | B | 1200 | 55 | 820 | 470 | 8 | 980 | 29 |
| 5 | B | 1190 | 50 | 890 | 450 | 2 | 1020 | 8 |
| 6 | B | 1180 | 45 | 990 | 425 | 8 | 1000 | 11 |
| 7 | C | 1180 | 42 | 920 | 436 | 10 | 895 | 11 |
| 8 | C | 1200 | 55 | 890 | 433 | 2 | 880 | 19 |
| 9 | C | 1200 | 51 | 870 | 400 | 8 | 890 | 75 |
| 10 | D | 1230 | 29 | 860 | 450 | 9 | 951 | 9 |
| 11 | D | 1230 | 45 | 820 | 410 | 12 | 920 | 9 |
| 12 | D | 1200 | 44 | 910 | 480 | 15 | 1160 | 9 |
| 13 | E | 1200 | 51 | 945 | 410 | 10 | 1010 | 15 |
| 14 | E | 1180 | 51 | 922 | 375 | 2 | 950 | 26 |
| 15 | E | 1190 | 41 | 930 | 380 | 10 | 900 | 19 |
| 16 | F | 1190 | 48 | 910 | 425 | 9 | 990 | 26 |
| 17 | F | 1180 | 49 | 920 | 622 | 12 | 990 | 3 |
| 18 | F | 1180 | 38 | 900 | 410 | 13 | 860 | 1 |
| 19 | G | 1190 | 45 | 890 | 362 | 11 | 950 | 2 |
| 20 | G | 1190 | 55 | 880 | 380 | 2 | 870 | 15 |
| 21 | G | 1050 | 51 | 880 | 398 | 10 | 845 | 35 |
| 22 | H | 1180 | 51 | 890 | 411 | 7 | 890 | 35 |
| 23 | H | 1190 | 48 | 1010 | 420 | 6 | 880 | 12 |
| 24 | H | 1200 | 55 | 920 | 425 | 3.5 | 890 | 10 |

| No. | Presence of galling marks at hot rolling | BH ($N/nm^2$) | Stretcher strain | Presence of surface roughening | |
|---|---|---|---|---|---|
| 1 | None | 2.5 | None | None | Invention Example |
| 2 | None | 13 | Yes | None | Comparative Example |
| 3 | None | 14 | Yes | None | Comparative Example |
| 4 | None | 3.5 | None | None | Invention Example |
| 5 | None | 9.9 | Yes | None | Comparative Example |
| 6 | None | 11 | Yes | None | Comparative Example |
| 7 | None | 4.2 | None | None | Invention Example |
| 8 | None | 8.9 | Yes | None | Comparative Example |
| 9 | None | 13 | Yes | None | Comparative Example |
| 10 | None | 13 | Yes | None | Comparative Example |
| 11 | None | 1.5 | None | None | Invention Example |
| 12 | None | 12 | Yes | Yes | Comparative Example |
| 13 | None | 3.2 | None | None | Invention Example |
| 14 | None | 14 | Yes | None | Comparative Example |
| 15 | None | 2 | None | None | Invention Example |
| 16 | None | 0.8 | None | None | Invention Example |
| 17 | None | 15 | Yes | None | Comparative Example |
| 18 | None | 12 | Yes | None | Comparative Example |
| 19 | None | 2.5 | None | None | Invention Example |
| 20 | None | 12 | Yes | None | Comparative Example |

TABLE 3-continued

| | | | | | |
|---|---|---|---|---|---|
| 21 | Yes | 9.3 | Yes | None | Comparative Example |
| 22 | None | 1.1 | None | None | Invention Example |
| 23 | None | 14 | Yes | None | Comparative Example |
| 24 | None | 2.3 | None | None | Invention Example |

X: Total rolling reduction (%) of last three passes of finish rolling t1: Heating rate (° C./s) in range from 500° C. to 700° C. in hot-rolled sheet annealing t2: Cooling rate (° C./s) in range from 850° C. to 550° C. in hot-rolled sheet annealing

TABLE 4

| No. | Steel | Heating temperature (° C.) | X (%) | Finish rolling temperature (° C.) | Coiling temperature (° C.) | t1 (° C./s) | Reaching temperature (° C.) | t2 (° C./s) |
|---|---|---|---|---|---|---|---|---|
| 25 | I | 1200 | 50 | 900 | 430 | 7 | 925 | 15 |
| 26 | I | 1200 | 45 | 890 | 410 | 8 | 922 | 10 |
| 27 | I | 1180 | 48 | 870 | 588 | 7 | 1000 | 15 |
| 28 | J | 1190 | 55 | 880 | 480 | 9 | 940 | 5 |
| 29 | J | 1180 | 50 | 890 | 490 | 2 | 1050 | 12 |
| 30 | J | 1200 | 45 | 880 | 382 | 8 | 1060 | 7 |
| 31 | K | 1160 | 45 | 885 | 360 | 11 | 1000 | 15 |
| 32 | K | 1160 | 41 | 880 | 395 | 1 | 980 | 10 |
| 33 | K | 1200 | 51 | 920 | 400 | 10 | 890 | 40 |
| 34 | L | 1180 | 52 | 910 | 412 | 9 | 860 | 6 |
| 35 | L | 1180 | 61 | 1020 | 419 | 9 | 880 | 12 |
| 36 | L | 1170 | 69 | 890 | 405 | 6 | 890 | 25 |
| 37 | M | 1180 | 42 | 900 | 400 | 1 | 980 | 25 |
| 38 | M | 1160 | 53 | 880 | 420 | 4 | 970 | 10 |
| 39 | M | 1200 | 42 | 920 | 440 | 5 | 950 | 100 |
| 40 | N | 1180 | 45 | 870 | 450 | 10 | 900 | 25 |
| 41 | N | 1180 | 35 | 875 | 455 | 20 | 1000 | 7 |
| 42 | N | 1170 | 42 | 850 | 610 | 10 | 920 | 11 |
| 43 | O | 1150 | 44 | 860 | 395 | 15 | 950 | 15 |
| 44 | O | 1190 | 52 | 1010 | 405 | 2 | 900 | 8 |
| 45 | O | 1200 | 60 | 880 | 420 | 5 | 800 | 59 |
| 46 | P | 1210 | 55 | 850 | 440 | 7 | 950 | 95 |
| 47 | P | 1200 | 48 | 860 | 450 | 10 | 920 | 15 |
| 48 | P | 1150 | 25 | 860 | 480 | 9 | 980 | 10 |

| No. | Presence of galling marks at hot rolling | BH ($N/nm^2$) | Stretcher strain | Presence of surface roughening | |
|---|---|---|---|---|---|
| 25 | None | 1.1 | None | None | Invention Example |
| 26 | None | 3.1 | None | None | Invention Example |
| 27 | None | 9.6 | Yes | None | Comparative Example |
| 28 | None | 2.3 | None | None | Invention Example |
| 29 | None | 12 | Yes | None | Comparative Example |
| 30 | None | 3.2 | None | None | Invention Example |
| 31 | None | 2.5 | None | None | Invention Example |
| 32 | None | 11 | Yes | None | Comparative Example |
| 33 | None | 3.2 | None | None | Invention Example |
| 34 | None | 3.5 | None | None | Invention Example |
| 35 | None | 12 | Yes | None | Comparative Example |
| 36 | None | 4.2 | None | None | Invention Example |
| 37 | None | 15 | Yes | None | Comparative Example |
| 38 | None | 0.9 | None | None | invention Example |
| 39 | None | 17 | Yes | None | Comparative Example |
| 40 | None | 3.5 | None | None | Invention Example |
| 41 | None | 18 | Yes | None | Comparative Example |
| 42 | None | 17 | Yes | None | Comparative Example |
| 43 | None | 5.8 | None | None | Invention Example |
| 44 | None | 19 | Yes | None | Comparative Example |
| 45 | None | 16 | Yes | None | Comparative Example |
| 46 | None | 13 | Yes | None | Comparative Example |
| 47 | None | 6.6 | None | None | Invention Example |
| 48 | None | 21 | Yes | None | Comparative Example |

X: Total rolling reduction (%) of last three passes of finish rolling t1: Heating rate (° C./s) in range from 500° C. to 700° C. in hot-rolled sheet annealing t2: Cooling rate (° C./s) in range from 850° C. to 550° C. in hot-rolled sheet annealing

TABLE 5

| No. | Steel | Heating temperature (° C.) | X (%) | Finish rolling temperature (° C.) | Coiling temperature (° C.) | t1 (° C./s) | Reaching temperature (° C.) | t2 (° C./s) |
|---|---|---|---|---|---|---|---|---|
| 49 | Q | 1160 | 60 | 900 | 350 | 15 | 1000 | 4 |
| 50 | Q | 1200 | 66 | 850 | 350 | 2 | 890 | 18 |
| 51 | Q | 1050 | 55 | 850 | 400 | 15 | 820 | 25 |
| 52 | R | 1200 | 55 | 880 | 430 | 18 | 910 | 20 |
| 53 | R | 1200 | 50 | 1020 | 410 | 10 | 940 | 23 |
| 54 | R | 1150 | 50 | 900 | 420 | 11 | 930 | 20 |
| 55 | S | 1150 | 48 | 900 | 440 | 8 | 920 | 100 |
| 56 | S | 1200 | 46 | 900 | 450 | 7 | 920 | 15 |
| 57 | S | 1180 | 48 | 880 | 600 | 8 | 950 | 15 |
| 58 | T | 1180 | 45 | 800 | 480 | 10 | 920 | 15 |
| 59 | T | 1200 | 48 | 820 | 425 | 20 | 890 | 25 |
| 60 | T | 1190 | 42 | 940 | 391 | 9 | 850 | 30 |
| 61 | U | 1180 | 32 | 920 | 525 | 8 | 975 | 6 |
| 62 | U | 1200 | 45 | 990 | 380 | 7 | 980 | 9 |
| 63 | U | 1180 | 41 | 900 | 416 | 6 | 1010 | 15 |
| 64 | V | 1150 | 51 | 910 | 454 | 5 | 1120 | 15 |
| 65 | V | 1160 | 51 | 880 | 461 | 1 | 1000 | 20 |
| 66 | V | 1200 | 48 | 870 | 420 | 10 | 980 | 35 |
| 67 | W | 1160 | 47 | 830 | 450 | 15 | 910 | 20 |
| 68 | W | 1180 | 41 | 850 | 440 | 10 | 980 | 15 |
| 69 | W | 1170 | 48 | 920 | 420 | 10 | 950 | 28 |
| 70 | X | 1150 | 30 | 900 | 550 | 15 | 940 | 10 |
| 71 | X | 1150 | 47 | 1000 | 410 | 8 | 990 | 5 |
| 72 | X | 1170 | 50 | 950 | 380 | 20 | 1000 | 20 |

| No. | Presence of galling marks at hot rolling | BH ($N/nm^2$) | Stretcher strain | Presence of surface roughening | |
|---|---|---|---|---|---|
| 49 | None | 3.1 | None | None | Invention Example |
| 50 | None | 14 | Yes | None | Comparative Example |
| 51 | Yes | 12 | Yes | None | Comparative Example |
| 52 | None | 0.9 | None | None | Invention Example |
| 53 | None | 16 | Yes | None | Comparative Example |
| 54 | None | 0 | None | None | Invention Example |
| 55 | None | 18 | Yes | None | Comparative Example |
| 56 | None | 2.5 | None | None | Invention Example |
| 57 | None | 11 | Yes | None | Comparative Example |
| 58 | None | 16 | Yes | None | Comparative Example |
| 59 | None | 13 | Yes | None | Comparative Example |
| 60 | None | 12 | Yes | None | Comparative Example |
| 61 | None | 17 | Yes | None | Comparative Example |
| 62 | None | 13 | Yes | None | Comparative Example |
| 63 | None | 14 | Yes | None | Comparative Example |
| 64 | None | 13 | Yes | Yes | Comparative Example |
| 65 | None | 15 | Yes | None | Comparative Example |
| 66 | None | 14 | Yes | None | Comparative Example |
| 67 | None | 21 | Yes | None | Comparative Example |
| 68 | None | 19 | Yes | None | Comparative Example |
| 69 | None | 31 | Yes | None | Comparative Example |
| 70 | None | 17 | Yes | None | Comparative Example |
| 71 | None | 15 | Yes | None | Comparative Example |
| 72 | None | 12 | Yes | None | Comparative Example |

X: Total rolling reduction (%) of last three passes of finish rolling
t1: Heating rate (° C./s) in range from 500° C. to 700° C. in hot-rolled sheet annealing
t2: Cooling rate (° C./s) in range from 850° C. to 550° C. in hot-rolled sheet annealing

INDUSTRIAL APPLICABILITY

According to the present invention, it is possible to effectively limit stretcher strain occurring when a ferritic stainless steel sheet is held at a high temperature for a long period of time. Accordingly, a stringent thin steel sheet storage method or the like can be relaxed and maintenance may not be required. Therefore, the present invention can contribute to industry.

The invention claimed is:

1. A ferritic stainless steel sheet comprising, as a steel composition, by mass %:

C: 0.020% or less;

Si: 0.01% to 2.0%;

Mn: 2.0% or less;

P: less than 0.050%;

S: less than 0.010%;

Cr: 10.0% to 25.0%;

N: 0.020% or less;

Sn: 0.010% to 0.50%;

Ca: 0.0003% to 0.0030%;

Ga: 0.0003% to 0.0021%;

one or more of Ti: 0.60% or less, Nb: 0.60% or less, V: 0.60% or less, and Zr: 0.60% or less so as to satisfy the following Equation (1); and a balance being Fe and inevitable impurities, wherein a stress σ1, in N/mm$^2$, when 7.5% of strain is applied and an upper yield stress σ2, in N/mm$^2$, after the steel sheet is subjected to a heat treatment at 200° C. for 30 minutes satisfy the following Equation (2), and the stress σ1 and the upper yield stress σ2 are measured by a method which includes, in series: taking a tensile test piece from the steel sheet in a direction parallel to a rolling direction; subjecting the tensile test piece to tensile deformation with 7.5% of strain to measure the stress σ1; subjecting the tensile test piece to the heat treatment at 200° C. for 30 minutes; and subjecting the tensile test piece to tensile deformation to measure the upper yield stress σ2:

$$(Ti/48+V/51+Zr/91+Nb/93)/(C/12+N/14)\geq 1.0 \quad \text{Equation (1)}$$

$$\sigma 2-\sigma 1\leq 8 \quad \text{Equation (2)},$$

wherein in Equation (1), each element name represents the amount, in mass %, thereof and the amount of an element not contained in the steel is substituted by 0.

2. The ferritic stainless steel sheet according to claim 1, further comprising, by mass %, Al: 0.003% to 1.0%.

3. The ferritic stainless steel sheet according to claim 1, further comprising, by mass %, one or more of, Ni: 0.01% to 2.0%, Cu: 0.01% to 2.0%, and Mo: 0.01% to 2.0%.

4. The ferritic stainless steel sheet according to claim 1, further comprising, by mass %, one or more of, B: 0.0003% to 0.0025%, Mg: 0.0001% to 0.0030%, Sb: 0.001% to 0.50%, REM (rare earth metal): 0.002% to 0.2%, and Ta: 0.005% to 0.50%.

5. The ferritic stainless steel sheet according to claim 2, further comprising, by mass %, one or more of, Ni: 0.01% to 2.0%, Cu: 0.01% to 2.0%, and Mo: 0.01% to 2.0%.

6. The ferritic stainless steel sheet according to claim 2, further comprising, by mass %, one or more of, B: 0.0003% to 0.0025%, Mg: 0.0001% to 0.0030%, Sb: 0.001% to 0.50%, REM (rare earth metal): 0.002% to 0.2%, and Ta: 0.005% to 0.50%.

7. The ferritic stainless steel sheet according to claim 3, further comprising, by mass %, one or more of, B: 0.0003% to 0.0025%, Mg: 0.0001% to 0.0030%, Sb: 0.001% to 0.50%, REM (rare earth metal): 0.002% to 0.2%, and Ta: 0.005% to 0.50%.

* * * * *